US009669968B2

(12) United States Patent
Kinskey et al.

(10) Patent No.: US 9,669,968 B2
(45) Date of Patent: Jun. 6, 2017

(54) LATCH FOR RELEASABLY COUPLING ELEMENTS TOGETHER

(71) Applicant: LF Centennial Ltd., Road Town, Tortola (VG)

(72) Inventors: Terrence P. Kinskey, Alpharetta, GA (US); Matthew G. Williams, Lighthouse Point, FL (US)

(73) Assignee: LF CENTENNIAL LTD., Road Town, Tortola (VG)

( * ) Notice: Subject to any disclaimer, the term of this patent is extended or adjusted under 35 U.S.C. 154(b) by 25 days.

(21) Appl. No.: 13/793,806

(22) Filed: Mar. 11, 2013

(65) Prior Publication Data

US 2014/0251998 A1 Sep. 11, 2014

(51) Int. Cl.

| | |
|---|---|
| ***B65D 45/28*** | (2006.01) |
| ***B65D 45/18*** | (2006.01) |
| ***B65D 45/22*** | (2006.01) |
| ***E05C 3/04*** | (2006.01) |

(52) U.S. Cl.

CPC ..... *B65D 45/18* (2013.01); *B65D 45/22* (2013.01); *E05C 3/048* (2013.01); *Y10T 292/0911* (2015.04)

(58) Field of Classification Search

USPC ..... 220/314, 324, 326; 292/285

See application file for complete search history.

(56) References Cited

U.S. PATENT DOCUMENTS

| | | | | |
|---|---|---|---|---|
| 2,889,087 | A * | 6/1959 | Paull | B65D 51/04 220/254.3 |
| 4,397,438 | A * | 8/1983 | Chapman | 248/229.16 |
| 4,989,744 | A * | 2/1991 | Tominaga | B65D 25/325 119/497 |
| 5,735,428 | A * | 4/1998 | Chern | 220/324 |
| 5,738,390 | A * | 4/1998 | Yemini | 292/87 |
| 6,085,928 | A * | 7/2000 | Dickinson et al. | 220/324 |
| 6,378,918 | B1 * | 4/2002 | Mita et al. | 292/103 |
| 6,571,740 | B1 * | 6/2003 | Kinder | A01K 1/0245 119/416 |
| 6,736,265 | B2 * | 5/2004 | Kipper et al. | 206/373 |
| 6,929,295 | B2 | 8/2005 | Nurenberg et al. | |
| 7,048,464 | B2 * | 5/2006 | Ronnquist | 403/321 |
| 7,401,698 | B2 * | 7/2008 | Dost et al. | 206/349 |
| 8,366,156 | B2 * | 2/2013 | Mercier et al. | 292/80 |
| 8,813,960 | B2 * | 8/2014 | Fjelland | 206/503 |
| 2003/0010783 | A1 * | 1/2003 | Prezelin | 220/324 |

* cited by examiner

*Primary Examiner* — Jeffrey Allen

(74) *Attorney, Agent, or Firm* — Duane Morris LLP; J. Rodman Steele, Jr.; Gregory M. Lefkowitz

(57) ABSTRACT

A replaceable latch and a container including the same are disclosed. The latch can include a latch plate; at least one clip, at least one projection for engaging a rod in the at least one clip; and a locking protrusion extending from the latch plate. Each clip can include a rod seat for rotatably engaging a rod. The container can include a first portion, comprising a mounting rod; a replaceable latch for rotatably coupling to the mounting rod; and a second portion, comprising a latch catch.

16 Claims, 6 Drawing Sheets

LATCH FOR RELEASABLY COUPLING ELEMENTS TOGETHER

FIELD OF THE INVENTION

This invention is directed generally to a latch for releasably coupling elements, such as container elements, together.

BACKGROUND

Latches are used in order to secure elements together. For example, U.S. Pat. No. 5,738,390 discloses the use of a hingeable latch for detachably or hingedly connecting a base and a cover. In the '390 Patent, a rod is mounted to a lid, with the rod passing through a cylindrically shaped portion of the latch. Similar, permanently mounted latches are disclosed in U.S. Pat. No. 6,378,918 and U.S. Pat. No. 6,736,265. An alternate latch configuration is disclosed in U.S. Pat. No. 6,929,295. However, there is still room for improvement over these known latch and container configurations.

SUMMARY OF THE INVENTION

One of the broader forms of the present disclosure relates to a replaceable latch. The latch can include a latch plate; at least one clip, at least one projection for engaging a rod in the at least one clip; and a locking protrusion extending from the latch plate. Each clip can include a rod seat for rotatably engaging a rod.

Another of the broader forms of the present disclosure relates to a container. The container can include a first portion, comprising a mounting rod; a replaceable latch for rotatably coupling to the mounting rod; and a second portion, comprising a latch catch. The latch can be any latch described herein adapted to releasably engage the latch catch.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
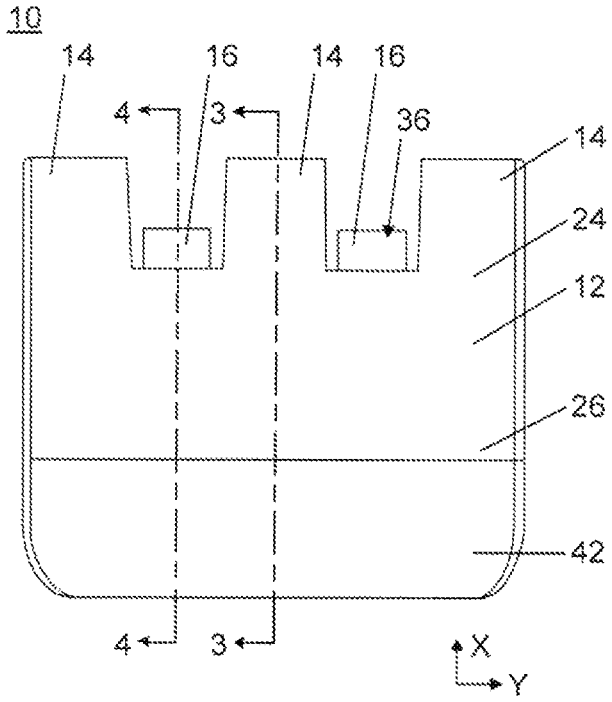
FIG. 1 is a front view of a latch in accordance with some embodiments.

A replaceable latch and a container including a replaceable latch are described. The replaceable latch is unique in that it can be easily attached or mounted to a rod of an object by sliding the rod longitudinally into the rod set of the latch. Once attached to the rod, the latch can pivot around the rod anchored at the clips. However, once mounted to the rod, the latch cannot be easily removed from the rod by moving the latch longitudinally, laterally or by twisting. Rather, removing the latch from the rod required sliding the rod out of latch laterally or serious deformation or even destruction of the latch.

As used herein, all relative terms are based on the latch itself regardless of the orientation of the latch. As used herein, "longitudinal" refers to vertical movement from the locking projection to the clip and is designated as the X-axis in the Figures, while "lateral" refers to movement across the width of the latch and is designated as the Y-axis in the Figures. The terms "front" and "back" refer to the direction orthogonal to both the X-axis and the Y-axis, and relate to the direction designated as the Z-axis in the Figures.

As shown in the Figures, a replacement latch 10 is described. The latch 10 can include a latch plate 12; at least one clip 14; at least one projection 16 for engaging a rod 18 in the at least one clip 14; and a locking protrusion 20 extending from the latch plate 12. Each clip 14 can include a rod seat 22 for rotatably engaging a rod 18 to which the clip 14 is coupled. The latch plate 12 can be planar or generally planar (i.e., slightly curved).

Figure 2:
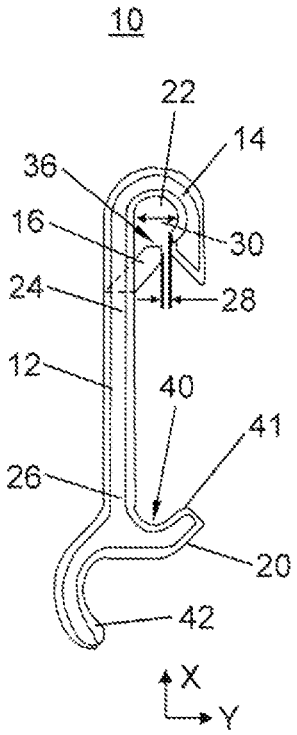
FIG. 2 is a side view of the latch of FIG. 1.
Figure 3:
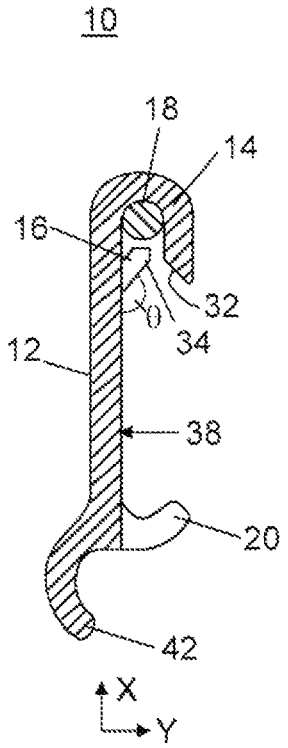
FIG. 3 is a cross-sectional view of the latch of FIG. 1 taken along cut line 3-3, showing a rod in the rod seat.
Figure 4:
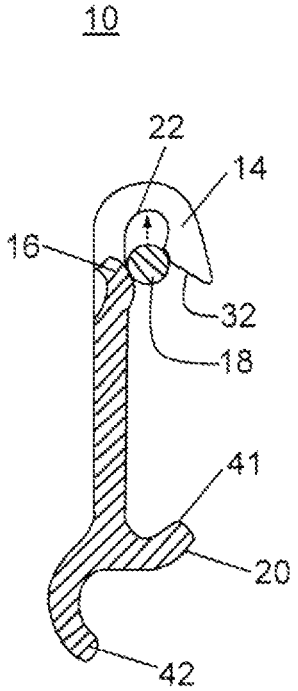
FIG. 4 is a cross-sectional view of the latch of FIG. 1 taken along cut line 4-4, showing a rod as is slides longitudinally past the projection into the rod seat.

The at least one clip 14 can have a generally C-shaped profile, as shown in FIGS. 2-4. The rod seat 22 can be the interior portion of the generally C-shaped profile. As shown in FIGS. 2-4, the thickness of the clip 14 can increase proximate a distal portion of the clip 14 in order to retain a rod 18 within the rod seat 22. Each of the clips 14 can have the same shape or substantially the same shape and the rod seats 22 for each of the clips 14 can be aligned. Similarly, each of the projections 16 can have the same shape or substantially the same shape.

The at least one clip 14 and the at least one projection 1 can extend from a top portion 24 of the latch plate 12 or a top edge of the latch plate 12. The locking protrusion 20 can extend from a bottom portion 26 of the latch plate 12 or a top edge of the latch plate 12. In some embodiments, as shown in FIGS. 2-5, the at least one clip 14, the at least one projection 16, and the locking protrusion 20 all extend backward from the latch plate 12.

Figure 5:
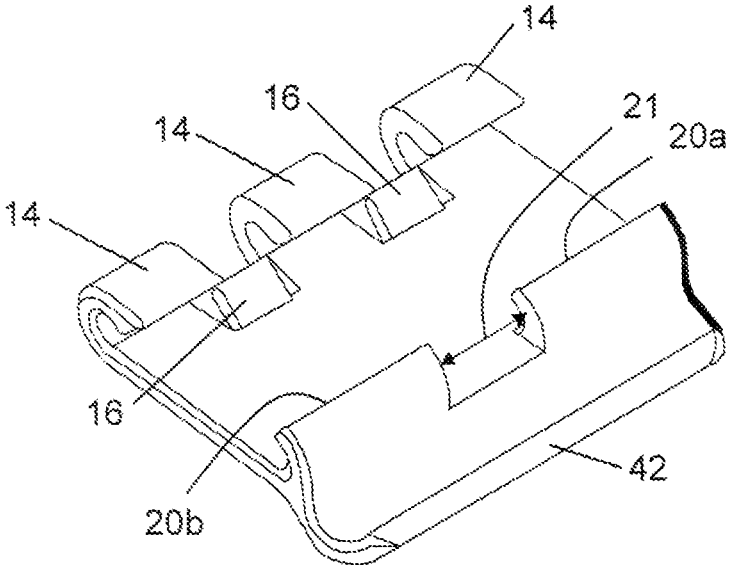
FIG. 5. is a back, perspective view of a larch in accordance with some embodiments.
Figure 6:
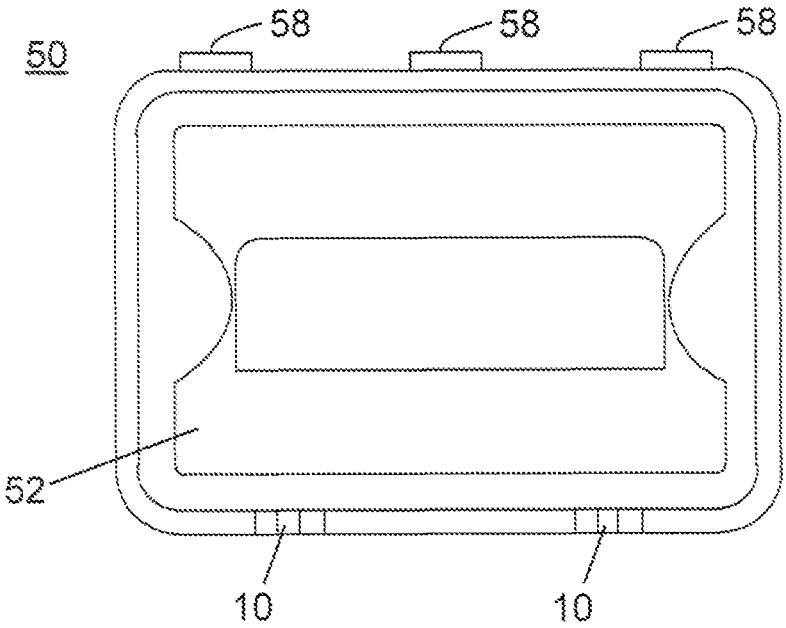
FIG. 6 is a top view of a container in accordance with some embodiments.
Figure 7:
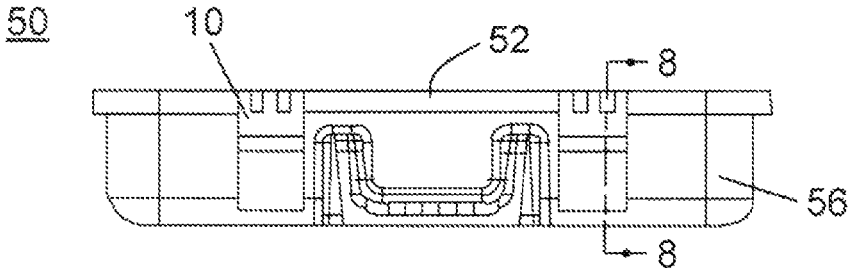
FIG. 7 is a front view of the container of FIG. 6.
Figure 9:
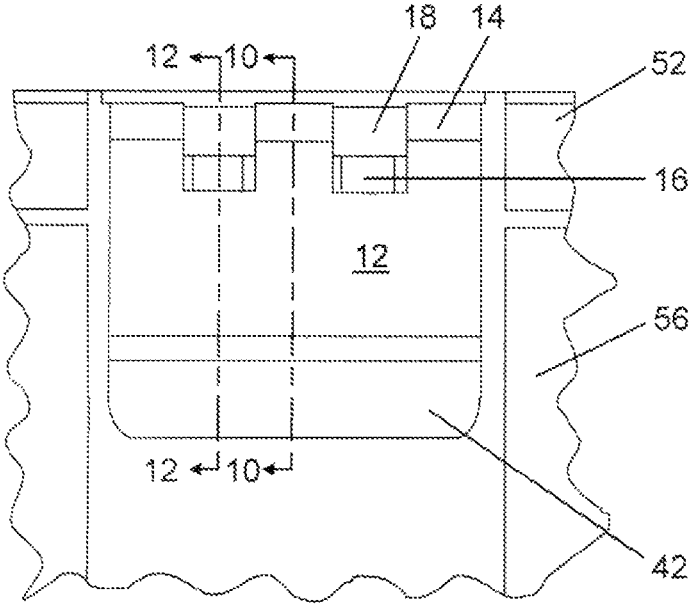
FIG. 9 is a close-up view of a latch as shown in FIG. 7.

The latch 10 can include at least two clips 14 laterally separated from one another and a projection 16 can be located between adjacent clips 14. In some embodiments, the latch 10 can include at least three clips 14 laterally separated from one another and a projection 16 located between each set of adjacent clips 14. For example, as shown in FIGS. 1, 5 & 9, the latch 10 can include three clips 14 with projections 16 between each of two sets of adjacent clips 14.

In some embodiments, a minimum gap 28 between the at least one projections 16 and the at least one clips 14 is smaller than a diameter 30 of the rod seat 22 of the clips 14. The minimum gap 28 can be located at a lower portion of the rod seat 22. As used herein, "minimum gap" is used to refer to the gap or overlap between the innermost portion of the distal portion of the clips 14 and an outermost portion of the projections 16 when viewed from the side, as shown in FIG. 2. Similarly, as best seen in FIGS. 2, 3 10 & 11, the rod seat 22 can have a generally circular shape when viewed from the side. As used herein, the diameter 30 of the rod seat 22 refers to the maximum distance between the front and the back of the rod seat 22 when viewed from the side, as shown in FIG. 2.

In other embodiments, the at least one projection 16 and the at least one clip 14 form a tapered opening leading to a rod seat 22 having a diameter 30 larger than the minimum gap 28 of the tapered opening. In such instances, the at least one clip 14 can have a tapered portion 32, the at least one projection 16 can have a tapered portion 34, or both. The tapered portions 32, 34 can be tapered when viewed from the side, as shown in FIG. 3.

In some embodiments, the at least one projections 16, the at least one clips 14, or both, are adapted to deform when a rod 18 slides longitudinally into the rod seat 22, while preventing a rod within the rod seat 22 from sliding out along the same path. For example, FIG. 4 shows both the clip 14 and the projection 16 deforming as a rod 18 slides longitudinally into the rod seat 22. FIG. 3 shows the rod 18 resting in the rod seat 22 where the clip 14 and the projection 16 have returned to their resting positions. In the resting position, a generally horizontal surface 36 of the projection 16 prevents the rod 18 from moving longitudinally through the minimum gap 28 and out of the rod seat 22.

The cups 14 and projections 16 can be formed of a resilient, deformable material, such as a plastic, a metal or an alloy (e.g., steel). In some embodiments, the body of the latch 10, including the clips 14, projections 16 and locking protrusion 20 can be formed of a single, indivisible body. Such latches, formed from a single, indivisible body, can be formed by injection molding and other similar techniques.

As shown in FIGS. 1-3 and 5, each projection 16 can be an angled strip extending backward from the latch plate 12. As shown in FIG. 4, the angled strip can 16 collapse substantially parallel to the latch plate 12 when a rod 8 slides into the rod seat 22. In the resting position, the angled strip 16 can extend at an angle (θ) of 110° or more relative to the back surface 38 of the latch plate 12. The angled strip 16 can extend at an angle (θ) of 120° or more, or angle (θ) of 130° or more relative to the back surface 38.

The projection 16 can include a tapered first side to allow a rod 18 to slide into the rod seat 22 and a stepped second side to prevent the rod 18 from sliding out of the rod seat 22 when moved longitudinally along the same path. While this describes a solid, ramp-shaped projection, it is equally applicable to the strip-shaped projection 16 shown in FIGS. 1-3 and 5. In the Figures, the projection includes a tapered first side 34 and a stepped second side 36.

Figure 12:
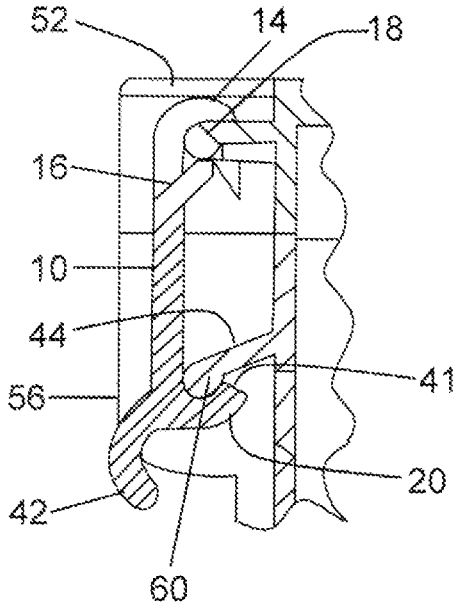
FIG. 12 is a cross-sectional view of the latch of FIG. 9 taken along cut line 12-12.

The locking protrusion 20 can extend backward from the latch plate 12. As best shown in FIG. 2, an interior surface 40 of the locking protrusion 20 can be concave. As best shown in FIGS. 4 & 12, the locking protrusion 20 can include a lip 41 for fitting over and releasably engaging the latch catch 44.

As shown in the Figures, a tab 42 can extend from the latch plate 12 proximate the locking protrusion 20. The tab 42 can be adapted to receive the fingertips of a user when the latch 10 is being coupled to or decoupled from the corresponding latch catch 44.

Figure 10:
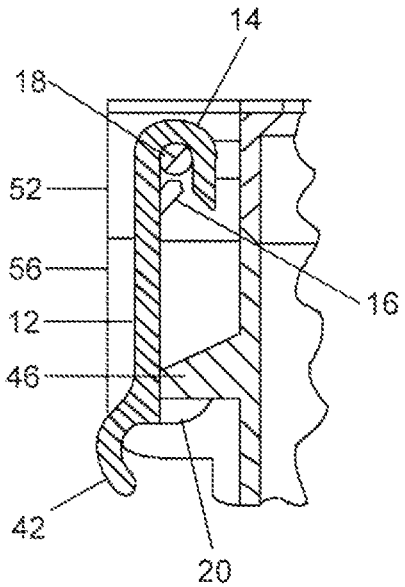
FIG. 10 is a cross-sectional view of the latch of FIG. 9 taken along cut line 10-10.

The locking protrusion 20 can be a single element or, as best shown in FIG. 5, can include at least one alignment gap 21 between adjacent locking protrusion portions 20*a*, 20*b*, etc. As shown in FIG. 10, the latch catch 44 can include an alignment rib 46 that fits within the alignment gap 21 when the latch 10 is releasably coupled to the latch catch 45.

Figure 8:
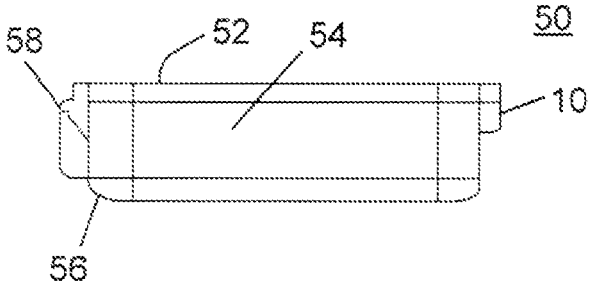
FIG. 8 is a cross-sectional view of the container of FIG. 7 taken along cut line 8-8.

As shown in FIGS. 6-13, a container 50 that includes at least one latch 10 as described herein is also described. The container 50 can include a first portion 52, comprising a mounting rod 18; a replaceable latch 10 for rotatably coupling to the mounting rod 18; and a second portion 56, comprising a latch catch 44. As shown in FIG. 8, the first portion 52 and the second portion 56 can define a storage volume 54. In some embodiments, the first portion 52 can be a lid and the second portion 56 can be the base of a storage container. In other embodiments, this arrangement can be reversed.

The first portion 52 and the second portion 56 can be rotatably coupled at a side opposite the mounting rod 18 and the latch catch 44. For example, as shown in FIG. 8, the first portion 52 and the second portion 56 can be rotatably coupled by a hinge 58. In other embodiments, the first portion 52 and the second portion 56 can be separate elements that can be completely decoupled during use, e.g., when a user is loading or unloading the container 50.

Figure 11:
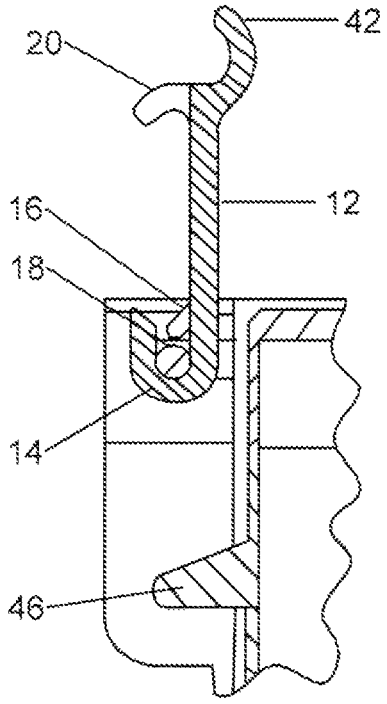
FIG. 11 is a view of FIG. 10 with the latch rotated up and away from the latch catch.
Figure 13:
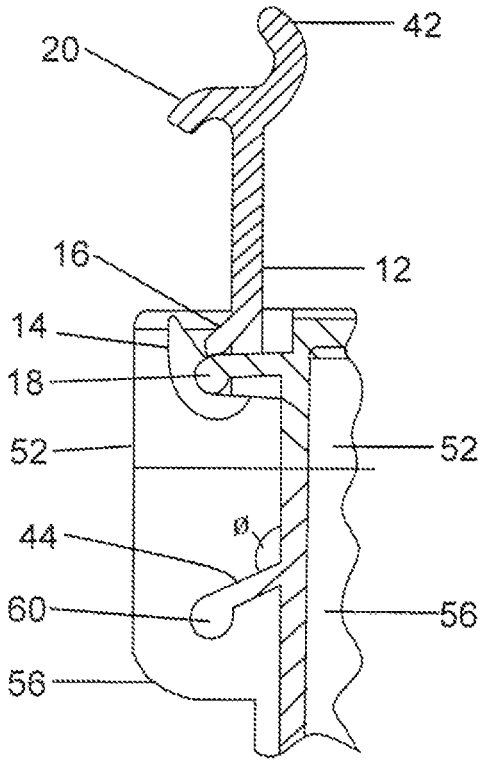
FIG. 13 is a view of FIG. 12 with the latch rotated up and away from the latch catch.

As shown in FIGS. 9-13, the locking protrusion 20 can releasably engage the latch catch 44 when the first portion 52 and the second portion 56 are in a closed configuration. FIGS. 11 & 13, show the position of the latch 10 after a user has released the locking protrusion 20 from the latch catch 44 by pulling the tab 42, thereby rotating the latch 10 away from the latch catch 44.

As best shown in FIGS. 12-13, the latch catch 44 can be a fin-type projection with a nub 60 extending down. As shown in FIG. 13, the latch catch 44 can extend down at an angle (ϕ) of at least 100°, or at least 110°, or at least 120°. In such embodiments, the lip 41 of the locking protrusion 20 can be shaped to slide over and behind the nub 60 of the latch catch 44. The locking protrusion 20, the latch catch 44, or both, can be adapted to temporarily deform when the locking protrusion 20 passes over the nub 60, Similarly, as best shown in FIGS. 12-13, the rod 18 can be a fin-type projection with a rod at the end portion. Alternately, the rod 18 can be cylindrical where the clips 14 are present, as shown in FIGS. 10-11, and can include fin-type projections supporting the rod 18 where the projections 16 are present, as shown in FIGS. 12-13.

In a first embodiment, a replacement latch is disclosed. The replacement latch can include a latch plate; at least one clip, wherein each clip comprises a rod seat for rotatably engaging a rod; at least one projection for engaging a rod in the at least one clip; and a locking protrusion extending from the latch plate.

A second embodiment can be the first embodiment, where the at least one clip and at least one projection extend from a top portion of the latch plate, and the locking protrusion extends from a bottom portion of the latch plate.

A third embodiment can be any of the foregoing embodiments were the at least one clip, the at least one projection and the locking protrusion all extend backward from the latch plate.

A fourth embodiment can be any of the foregoing embodiments where the at least two clips laterally separated from one another, and a projection is disposed between adjacent clips.

A fifth embodiment can be any of the foregoing embodiments where a minimum gap between the at least one projections and the at least one is smaller than a diameter of a rod seat of the clips.

A sixth embodiment can be any of the foregoing embodiments where the at least one projections and the at least one clips form a tapered opening leading to a rod seat having a diameter larger than a minimum gap of the tapered opening.

A seventh embodiment can be any of the foregoing embodiments where the at least one projections, the at least one clips, or both are adapted to deform when a rod slides into the rod seat, while preventing a rod within the at least one clips from sliding out along the same path.

An eighth embodiment can be any of the foregoing embodiments where the at least one projections comprise an angled strip extending backward from the latch plate, wherein each angled strip can collapse substantially parallel to the latch plate when a rod slides into the rod seat.

A ninth embodiment can be any of the foregoing embodiments where the at least one projection comprises a tapered first side to allow a rod to slide into the rod seat and a stepped second side to prevent a rod from sliding out of the clip along the same path.

A tenth embodiment can be any of the foregoing embodiments where the locking protrusion comprises a lip for fitting over and releasably engaging a latch catch.

An eleventh embodiment can be any of the foregoing embodiments further comprising a tab extending proximate the locking protrusion.

A twelfth embodiment is drawn to a container that includes a first portion, comprising a mounting rod; a replaceable latch for rotatably coupling to the mounting rod; and a second portion, comprising a latch catch. The replaceable latch can be any of the replaceable latches disclosed in the first through eleventh embodiments.

A thirteenth embodiment can be the twelfth embodiment where the first portion and the second portion are rotatably coupled at a side opposite the mounting rod and the latch catch.

A fourteenth embodiment can be either of the twelfth or thirteenth embodiments where the looking protrusion can releasably engage the latch catch when the first portion and the second portion are in a closed configuration.

A fifteenth embodiment can be any of the twelfth through fourteenth embodiments where the first portion is a cover and the second portion is a base, or wherein the first portion is a base and the second portion is a cover.

A sixteenth embodiment can be any of the twelfth through fifteenth embodiments, where the at least one clip and at least one projection extend from a top portion of the latch plate, and the locking protrusion extends from a bottom portion of the latch plate.

A seventeenth embodiment can be any of the twelfth through sixteenth embodiments, where the at least one clip, the at least one projection and the locking protrusion all extend backward from the latch plate.

A eighteenth embodiment can be any of the twelfth through seventeenth embodiments, where the at least one projections and the at least one clips form a tapered opening for receiving a rod having a diameter larger than a minimum gap of the opening.

A nineteenth embodiment can be any of the twelfth through eighteenth embodiments, where the at least one projections, the at least one clips, or both are adapted to deform when a rod slides into the rod seat, while preventing a rod within the at least one clips from sliding out along the same path.

A twentieth embodiment can be any of the twelfth through nineteenth embodiments, were the at least one projection comprises a tapered first side to allow a rod to slide into the rod seat and a stepped second side to prevent a rod from sliding out of the rod seat along the same path The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A replaceable latch, comprising:

a latch plate;

at least two clips laterally separated from one another, wherein each clip comprises a rod seat for rotatably engaging a rod;

at least one projection for engaging a rod in the at least one clip, wherein each projection is located between adjacent clips; and a locking protrusion extending from the latch plate, wherein the at least one clip and at least one projection extend from a upper portion of the latch plate, the locking protrusion extends from a lower portion of the latch plate, and wherein the at least one projections and the at least one clip form a downward facing opening leading to the rod seat, which has a diameter larger than a minimum gap of the downward facing opening, wherein each of the projections comprises an angled strip that, when in a resting position, extends backward from the latch plate, wherein a portion of each angled strip collapses toward the latch plate and into a gap between adjacent clips when a rod slides into the rod seat.

2. The replaceable latch according to claim 1, wherein the at least two clips, the at least one projection and the locking protrusion all extend backward from the latch plate.

3. The replaceable latch according to claim 1, wherein, in a resting position, a distal end of each projection extends behind a back surface of the latch plate.

4. The replaceable latch according to claim 1, wherein the downward facing opening is a tapered opening, wherein the minimum gap is defined by a distal end of one of the projections and a generally vertical portion of a distal portion of an adjacent clip.

5. The replaceable latch according to claim 1, wherein the locking protrusion comprises a lip for fitting over and releasably engaging a latch catch.

6. The replaceable latch according to claim 1, wherein the locking protrusion comprises at least two locking protrusion portions, wherein each pair of adjacent locking protrusion portions is separated by an alignment gap.

7. A container, comprising:

a first portion, comprising a mounting rod;

a replaceable latch for rotatably coupling to the mounting rod; and a second portion, comprising a latch catch, wherein the replaceable latch comprises:

a latch plate, at least two clips laterally separated from one another, wherein each clip comprises a rod seat for rotatably engaging a rod;

at least one projection for engaging a rod in the at least one clip, wherein each projection is located between adjacent clips; and a locking protrusion extending from the latch plate, wherein the at least one clip and at least one projection extend from a upper portion of the latch plate, the locking protrusion extends from a lower portion of the latch plate, and wherein the at least one projections and the at least one clip form a downward facing opening leading to the rod seat, which has a diameter larger than a minimum gap of the downward facing opening, wherein each of the projections comprises an angled strip extending backward from the latch plate, wherein a portion of each angled strip collapses toward the latch plate and into a gap between adjacent clips when a rod slides into the rod seat.

8. The container according to claim 7, wherein the first portion and the second portion are rotatably coupled at a side opposite the mounting rod and the latch catch.

9. The container according to claim 7, wherein the locking protrusion can releasably engage the latch catch when the first portion and the second portion are in a closed configuration.

10. The container according to claim 7, wherein the first portion is a cover and the second portion is a base, or wherein the first portion is a base and the second portion is a cover.

11. The container according to claim 7, wherein the at least one clip, the at least one projection and the locking protrusion all extend backward from the latch plate.

12. The container according to claim 7, wherein the downward facing opening is a tapered opening for receiving a rod having a diameter larger than a minimum gap of the downward facing opening.

13. The replaceable latch according to claim 1, wherein a thickness of a distal end of each projection comprises (i) a generally vertical first side that horizontally overlaps with a distal portion of the at least one clip to produce a minimum gap at a bottom end of the rod seat, and (ii) a generally horizontal second side to prevent a rod from sliding vertically out of the rod seat.

14. The replaceable latch according to claim 13, wherein the generally horizontal second side is adapted to prevent the rod within the at least one clip from sliding vertically out of the at least one clip.

15. The replaceable latch according to claim 1, wherein, when a rod is positioned in the rod seat, each of the projections is biased to resist the rod from being removed from the rod seat.

16. The replaceable latch according to claim 1, wherein, when a rod is positioned in the rod seat, a distal end of each of the projections rests below the rod to prevent the rod from being removed from the rod seat.

* * * * *